US009402290B2

(12) United States Patent
Kikkawa et al.

(10) Patent No.: US 9,402,290 B2
(45) Date of Patent: Jul. 26, 2016

(54) AUTOMATIC COLOR ADJUSTMENT ON LED VIDEO SCREEN

(71) Applicants: Lighthouse Technologies Limited, Shatin N.T. (CN); Lighthouse Technologies (Huizhou) Limited, Huizhou (CN)

(72) Inventors: Shinsaku Kikkawa, Kanagawa (JP); Kui Lai Curie Chan, Kowloon (CN)

(73) Assignees: Lighthouse Technologies Limited, Shatin, N.T. (HK); Lighthouse Technologies (Huizhou) Limited, Huizhou (CN)

( * ) Notice: Subject to any disclaimer, the term of this patent is extended or adjusted under 35 U.S.C. 154(b) by 0 days.

(21) Appl. No.: 14/800,117

(22) Filed: Jul. 15, 2015

(65) Prior Publication Data

US 2015/0319819 A1 Nov. 5, 2015

Related U.S. Application Data

(62) Division of application No. 13/683,774, filed on Nov. 21, 2012.

(51) Int. Cl.
*H05B 33/08* (2006.01)

(52) U.S. Cl.
CPC ..... *H05B 33/0851* (2013.01); *H05B 33/0869* (2013.01)

(58) Field of Classification Search
USPC ..... 315/149, 151, 152, 185 R, 291; 345/82, 345/84, 204, 690, 214
See application file for complete search history.

(56) References Cited

U.S. PATENT DOCUMENTS

2005/0280766 A1* 12/2005 Johnson ..... G09G 3/3216 349/167
2008/0018570 A1* 1/2008 Gerets ..... G09G 3/3208 345/84
2010/0007588 A1* 1/2010 Zygmunt ..... G09G 3/30 345/83

FOREIGN PATENT DOCUMENTS

CN 1908748 A 2/2007
CN 101105913 A 1/2008
CN 102622960 A 8/2012
JP 2008117713 5/2008

OTHER PUBLICATIONS

Aug. 15, 2013, International Search Report and Written Opinion from PCT International Application No. PCT/CN2012/087929.

* cited by examiner

*Primary Examiner* — Thai Pham
(74) *Attorney, Agent, or Firm* — Schiff Hardin LLP

(57) ABSTRACT

A system and method for the automatic color/brightness adjustment of a video display screen, panel, module or other display component comprising light emitting diodes ("LEDs"). The system and method incorporate a reference LED and a light sensor on each module and use decay information sensed from each reference LED to determine the amount of decay experienced by the display LEDs in the modules. Each module will be adjusted to have one uniform color/brightness level based on the decay information sensed from each reference LED.

13 Claims, 2 Drawing Sheets

100

20

20a

206

20c

100

| | | | | | | | | | | | |
|---|---|---|---|---|---|---|---|---|---|---|---|
| 66 | 65 | 68 | 70 | 68 | 71 | 75 | 68 | 67 | 66 | 70 | 60 |
| 60 | 68 | 71 | 75 | 68 | 67 | 66 | 70 | 80 | 66 | 65 | 68 |
| 67 | 66 | 70 | 80 | 68 | 71 | 60 | 68 | 71 | 75 | 68 | 67 |
| 68 | 71 | 75 | 68 | 60 | 68 | 71 | 75 | 68 | 67 | 68 | 71 |
| 67 | 66 | 70 | 80 | 68 | 71 | 60 | 68 | 71 | 75 | 68 | 67 |
| 68 | 71 | 60 | 68 | 71 | 75 | 68 | 67 | 67 | 66 | 70 | 80 |
| 67 | 66 | 70 | 67 | 66 | 70 | 80 | 68 | 68 | 71 | 75 | 68 |
| 60 | 68 | 71 | 75 | 68 | 67 | 60 | 68 | 71 | 75 | 68 | 100 |

FIG. 2

100

20

| | | | | | | | | | | | |
|---|---|---|---|---|---|---|---|---|---|---|---|
| 60 | 60 | 60 | 60 | 60 | 60 | 60 | 60 | 60 | 60 | 60 | 60 |
| 60 | 60 | 60 | 60 | 60 | 60 | 60 | 60 | 60 | 60 | 60 | 60 |
| 60 | 60 | 60 | 60 | 60 | 60 | 60 | 60 | 60 | 60 | 60 | 60 |
| 60 | 60 | 60 | 60 | 60 | 60 | 60 | 60 | 60 | 60 | 60 | 60 |
| 60 | 60 | 60 | 60 | 60 | 60 | 60 | 60 | 60 | 60 | 60 | 60 |
| 60 | 60 | 60 | 60 | 60 | 60 | 60 | 60 | 60 | 60 | 60 | 60 |
| 60 | 60 | 60 | 60 | 60 | 60 | 60 | 60 | 60 | 60 | 60 | 60 |
| 60 | 60 | 60 | 60 | 60 | 60 | 60 | 60 | 60 | 60 | 60 | 60 |

FIG. 3

AUTOMATIC COLOR ADJUSTMENT ON LED VIDEO SCREEN

CROSS-REFERENCE TO RELATED APPLICATIONS

This application is a divisional of U.S. Ser. No. 13/683,774, filed Nov. 21, 2012, which is incorporated herein by reference.

BACKGROUND OF THE INVENTION

The present invention relates to lighting devices and methods. In particular, the present invention relates to a method and system for the automatic color adjustment of a video display screen, panel, module or other display component comprising light emitting diodes.

Today, it is common for video displays to use light-emitting diodes ("LEDs") because of the brightness and low power requirements of the LEDs. LED video screens are used as digital billboards to display e.g., advertisements, textual and/or graphical informational messages, and live or prerecorded videos throughout cities and towns and at sporting events, concerts, and other appropriate venues (e.g., inside or outside of buildings). LED video screens, also referred to as LED display walls, are made up of individual panels and/or intelligent modules (IM) having a predetermined number and arrangement of controllable LEDs. The panels and/or modules are mounted next to each other and their outputs are controlled such that they appear to be one large display screen.

Unfortunately, LEDs are known for decaying over time. This means that the LEDs will not be as bright and/or as colorful as they were prior to their first use. Thus, after monthly and yearly operation of an LED video screen, the LEDs on the panels, modules, etc. that make-up the screen will eventually decay, affecting the brightness and/or color of the screen. Depending upon how the LED video screen was being used and what it had been displaying, the decay level of the LEDs on the individual panels and modules may be different from panel to panel and module to module. That is, because some LEDs will be used more frequently than others depending upon e.g., their location and what the screen was being used to display, uniformity of the screen (particularly with respect to it brightness and color output) will get worse over time.

Currently, there are techniques for adjusting the LED screen's color and brightness, but they are manually intensive. As used herein, the term "color adjustment" will refer to color and or brightness adjustment. Oftentimes a web camera, or other digital camera, is used with other equipment external to the LED screen to capture the screen's output. The external equipment includes, but is not limited to, light sensors and a computer that are separate from the screen's control panel. Moreover, a human operator is required to set up and control the equipment, determine test results, and execute the adjustment process. The external equipment and need for a human operator renders the typical automatic color adjustment technique costly, time consuming and inefficient.

Accordingly, there exists a need to provide an automatic color adjustment scheme for a video screen, display panel, module or other component comprising light emitting diodes.

BRIEF SUMMARY OF THE INVENTION

In consideration of the above problems, in accordance with one aspect disclosed herein, a light emitting module is provided. The module comprises a plurality of display light emitters connected to a first side of a circuit board; a reference light emitter connected to a second side of the circuit board; and a first circuit for determining an amount of decay experienced by the plurality of display light emitters based on light emitted from the reference light emitter.

In another embodiment, a light emitting video screen is provided. The screen comprises a plurality of light emitting modules. Each light emitting module comprises a plurality of display light emitters connected to a first side of a circuit board; a reference light emitter connected to a second side of the circuit board; and a first circuit for determining an amount of decay experienced by the plurality of display light emitters based on light emitted from the reference light emitter.

In yet another embodiment a light emitting video system is provided. The video screen comprises a plurality of display light emitters and a plurality of reference light emitters; and a controller coupled to control the video screen and perform automatic adjustment of the plurality of display light emitters based on light output from the reference light emitters.

In a further embodiment, a method of performing automatic color correction of a light emitting video screen comprising a plurality of light emitting modules is provided. The method comprises for each module, inputting a current light level from a reference light emitter on the module; for each module, comparing the current light level to a reference level of the reference light emitter to an output level of the module; comparing the output levels of all of the light emitting modules to determine the lowest light level; and adjusting the light level of all of the modules such that all of the display light emitters have the determined smallest light level.

BRIEF DESCRIPTION OF THE DRAWINGS

The figures are for illustration purposes only and are not necessarily drawn to scale. The invention itself, however, may best be understood by reference to the detailed description which follows when taken in conjunction with the accompanying drawings in which:

FIG. 2 shows an LED video screen comprised of a plurality of LED display modules illustrated in FIG. 1 during the automatic color adjustment process disclosed herein; and FIG. 3 shows the LED video screen of FIG. 2 after the automatic color adjustment process disclosed herein.

DETAILED DESCRIPTION OF THE INVENTION

Figure 1:
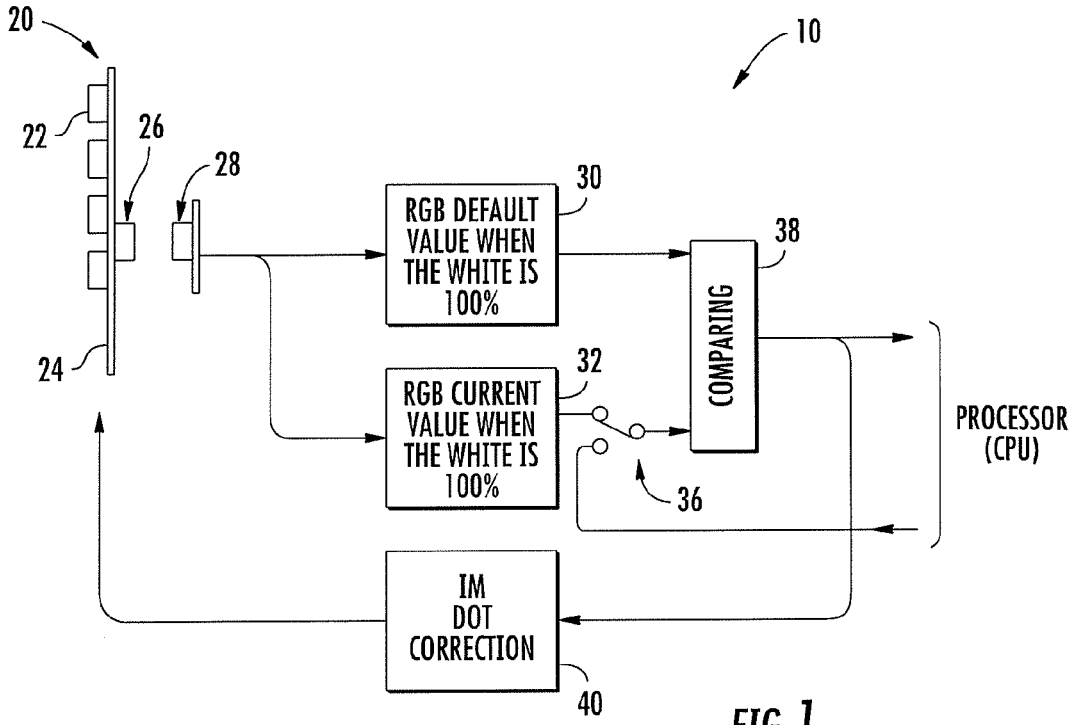
FIG. 1 shows a system for the automatic color adjustment of an LED display module constructed in accordance with the disclosed principles.

In accordance with preferred embodiments disclosed herein, a system and method for performing automatic color adjustment on an LED video screen, display panel, module or other component is provided. The disclosed system and method periodically or constantly ensures the uniformity of the LED video screen, etc. automatically and without the need for human intervention. As such, the disclosed system and method is more efficient and less costly than today's manual color adjustment schemes.

FIG. 1 illustrates a system 10 for the automatic color adjustment of an LED display intelligent module 20 constructed in accordance with the disclosed principles. In the illustrated embodiment, because LED video screens (e.g., LED video screen 100 illustrated in FIG. 2) are comprised of panels comprising a plurality of intelligent modules, the system 10 is designed to test the color/brightness at the intelligent module 20 level. This provides the best technique for ensuring the uniformity of the screen.

A shown in FIG. 1, each module 20 comprises a plurality of display LEDs 22 mounted to a circuit board 24. The modules 20 can comprise any number of display LEDs 22. In normal operation, a processor (or control panel) sends signals to the circuit board 24, which drives the LEDs 22 to emit light in the desired manner. As noted above, since LEDs 22 can decay over time, there is a need for a better mechanism for performing color adjustment for the module 20 and the overall screen. Thus, the disclosed system 10 uses a reference LED 26 mounted to a side of the circuit board 24 that is opposite the side where the display LEDs 22 are mounted. In the illustrated embodiment, the display LEDs 22 will be on a front side of the circuit board 24 where they will be visible to someone looking at the video screen and the reference LED 26 is mounted to the backside of the circuit board 24 where it will not be visible to someone looking at the screen. During normal operation of the module 20, the reference LED 26 will be driven in the same manner that the display LEDs 22 are driven. This way, the reference LED 26 experiences the same decay as the display LEDs 22.

Spaced apart from the reference LED 26 is a light sensor 28 that is also secured to the circuit board 24 (not shown) or other portion of the module 20. During the initial use of the module 20 (i.e., at the factory) and during the automatic adjustment process, the light sensor 28 will sense the output from the reference LED 26 and output a corresponding signal to the same processor or control panel that is used to drive the reference LEDs 22. It should be appreciated that there is no need for the light sensor 28 to sense the output of the reference LED 26 unless the output is needed for the automatic color adjustment process (described below).

The system 10 includes a first memory device 30 that stores the color/brightness information from the reference LED 26 (via the light sensor 28) upon the initial use of the module 20. This may occur at the factory where the module 20 was manufactured and initially set-up and tested. In a desired embodiment, the first memory device 30 will store the color/brightness information from the reference LED 26 (via the light sensor 28) upon the initial use of the module 20 in the LED video screen with its control panel. As will become apparent, the information stored in the first memory device 30 will be used as a reference level (i.e., 100% fully functional LED 26 without decay) throughout the automatic color adjustment process. The system 10 includes a second memory device 32 that stores the current color/brightness information from the reference LED 26 (via the light sensor 28) after the initial use of the module 20. The information in the second memory device 32 will be updated every time the automatic color adjustment process is executed to ensure that the current state of the reference LED 26 is captured.

The first memory device 30 is preferably a non-volatile memory device (e.g., a programmable ROM such as a serial programmable read only memory ("SPROM"), electrically erasable programmable read only memory ("EEPROM"), battery backed random access memory ("BRAM"), etc.) and preferably resides in the module 20. The second memory device 32 can be part of the first memory device 30 if the first memory device 30 is a programmable non-volatile memory (e.g., an EEPROM or BRAM). The second memory device 32 could be a separate memory device or hardware register, if desired. It should be appreciated that the second memory device 32 does not need to be a non-volatile memory device as its contents will be periodically changing. Moreover, the second memory device 32 is preferably contained within the module 20, but it should be appreciated that the second memory device 32 could reside within the screen's control panel as a separate memory or as part of a larger memory and can even be represented by a software table.

The information in the two memory devices 30, 32 will be compared (shown as a separate "comparing" component 38) and analyzed by the processor or control panel to determine any decay that the reference LED 26 is experiencing. Hereinafter, the term "control panel" will be used to refer to a processor, controller or control panel used to control the LED video screen and its individual modules 20. The comparing component 38 can be implemented in hardware or software and preferably resides on the module 20. It should be appreciated, however, that the comparing component 38 does not need to be a separate component from the control panel and that the present embodiment should not be limited as such. That is the function performed by the comparing component 38 can be implemented by the control panel, if desired. FIG. 1 also illustrates a switch 36 that connects the second memory device 32 to the comparing component 38 when the switch 36 is in a first position and connects the control panel to the comparing component 38 when the switch 36 is in a second position. The two connections of the switch 36 illustrate a first situation in which the information from the second memory device 32 is input by the comparing component 38, which then makes a comparison of the current output level of the reference LED 26 to the stored reference level of the reference LED 26 and a second situation in which the control panel outputs an adjustment level to the comparing component 38, which is then used by a dot correction component 40 to adjust the output level of the display LEDs 22 (discussed below).

The switch 36 is controlled by the control panel when it is time to perform the automatic adjustment process. Thus, all of the components of the system 10 that are necessary to perform the automation color adjustment are part of or reside within the module 20 such that they can be driven by the control panel, output results of the comparison, and implement the needed dot correction as directed by the control panel. It should be appreciated that the illustrated embodiment is not limited to this switching arrangement and that all of the comparing functions, analyzing of the compared signals and the implementation of the dot correction can be performed by the control panel, if desired.

FIG. 2 shows an LED video screen 100 comprised of a plurality of LED display modules 20 illustrated in FIG. 1. In the illustrated embodiment, the screen 100 is organized as an array of the modules 20. In a desired embodiment, the reference LED 26 of each module 20 included in the screen 100 is initially tested by being driven to 100% white color. Each sensor 28 senses the output of its associated reference LED 26 and outputs the value to the first memory device 30 contained within the module 20. This initial value is permanently stored and used subsequently as the reference value for the individual module 20. This test can be performed in the factory before or after the modules 20 are included as part of a display panel or the end product LED video screen 100. In one embodiment, this initial test and storage of the reference value is performed by the control panel used to control the screen 100 the first time the control panel activates the screen 100.

During normal operation of the video screen 100, each reference LED 26 is driven in the same manner as the display LEDs 22, this way the reference LEDs 26 experience the same decay as the display LEDs 22. When it is time to run the automatic adjustment process, the control panel drives the reference LEDs 26 with the 100% white color and switches the switches 36 such that the sensed outputs of the reference LEDs 26 (via the sensors 28) are sent to the associated comparing components 38. The outputs from the comparing components 38 are processed by the lone control panel used to control the screen 100, which determines the percentage each module 20 has decayed. The control panel subtracts the percentage of decay from 100% to determine each module's 20 current color/brightness percentage. The control panel then assigns the new color/brightness percentage to each module 20 in the screen 100.

FIG. 2 shows example color/brightness percentages that the control panel has assigned to the various modules 20 in the screen 10. For example, module 20*a* has a 60% color/brightness percentage, module 20*b* has a 67% color/brightness percentage while module 20*c* still has a 100% color/brightness percentage (i.e., it has experienced no decay). If left uncorrected, the color/brightness of the screen 100 would vary at each module 20, leaving it with a non-uniform color/brightness. The control panel, however, compares all of the color/brightness percentages to find the smallest value. In the FIG. 2 example, the smallest color/brightness percentage is the 60% associated with module 20*a* and the other shaded modules in the screen 100. The control panel will use the smallest value (i.e., 60%) as the color/brightness level for each module 20 such that the screen 100 will have a uniform color/brightness output.

The processor switches the switch 36 to the second position and outputs the uniform color/brightness level to the dot correction component 40 on each module 20 (via the comparing component 38). Each module 20 is then corrected by the dot correction component 40 such that all display LEDs 22 of each module 20 operate at the uniform color/brightness percentage. FIG. 3 shows the LED video screen 100 of FIG. 2 after undergoing the automatic color adjustment process disclosed herein. As can be seen, all of the display LEDs 22 of each module 20 will operate at the color/brightness percentage of 60%. Thus, the screen 100 will now have a uniform display despite the fact that the display LEDS 22 of the various modules 20 making up the screen 100 have different levels of decay.

It should be appreciated that the control panel could perform the automatic color adjustment process periodically at any desired rate. A timer or other mechanism on the control panel could be used so that uniformity can be kept automatically. By having all of the system 10 within the individual modules 20, no human intervention or external equipment is required to implement the disclosed automatic color adjustment scheme except for the same control panel that id used to operate the screen 100. As such, the system and method disclosed herein is more efficient and cost effective than traditional adjustment processes.

Although specific embodiments have been illustrated and described herein, it will be appreciated by those of ordinary skill in the art that a variety of alternate and/or equivalent implementations may be substituted for the specific embodiments shown and described without departing from the scope of the present invention. This application is intended to cover any adaptations or variations of the specific embodiments discussed herein. Therefore, it is intended that this invention be limited only by the claims and the equivalents thereof.

What is claimed is:

1. A method of performing automatic color correction of a light emitting video screen comprising a plurality of light emitting modules with display light emitters, said method comprising:

for each light emitting module, receiving a current light level from a reference light emitter on the module;

for each light emitting module, comparing, using a comparing component, the current light level to a reference level of the reference light emitter to generate an output level of the corresponding light emitting module;

comparing, using a controller, each of the output levels of the plurality of light emitting modules to determine a lowest light level;

providing the lowest light level from the controller to a correction component via the comparing component; and adjusting, using the correction component, a light level of the plurality of light emitting modules such that the display light emitters have the determined lowest light level received by the correction component from the controller via the comparing component.

2. The method of claim 1, wherein the light level corresponds to a color level of the light emitters.

3. The method of claim 1, wherein the light level corresponds to a brightness level of the light emitters.

4. The method of claim 1, wherein the reference level for each light emitting module is obtained at an initial operation of the corresponding light emitting module, the reference level being stored in a first memory on the corresponding light emitting module.

5. The method of claim 4, wherein the current light level for each light emitting module is obtained after the corresponding light emitting module has been operating as part of the screen, the current light level being stored in a second memory on the corresponding light emitting module.

6. The method of claim 1, wherein the method is repeated periodically to ensure the uniformity of the output level of the light emitting video screen.

7. The method of claim 1, wherein each light emitting module comprises:

the display light emitters connected to a first side of a circuit board;

the reference light emitter connected to a second side of the circuit board; and a first circuit configured to determine an amount of decay experienced by the display light emitters based on light emitted from the reference light emitter.

8. The method of claim 7, wherein the first circuit comprises the comparing component.

9. The method of claim 7, wherein the amount of decay is determined based on the output level of the corresponding light emitting module and the light emitted from the reference light emitter.

10. The method of claim 7, wherein each light emitting module further comprises a switch configured to:

receive the current light level from the reference light emitter;

receive the lowest light level from the controller; and selectively provide the current light level to the comparing component in a first mode of operation and the lowest light level to the comparing component in a second mode of operation.

11. The method of claim 10, wherein the controller is configured to control the switch to switch between the first and the second modes of operation.

12. The method of claim 1, further comprising:

selectively providing the current light level from the reference light emitter to the comparing component in a first mode of operation and the lowest light level from the controller to the comparing component in a second mode of operation.

13. The method of claim 12, wherein the controller is configured to select between the first and the second modes of operation.

* * * * *